US005214740A

United States Patent [19]

Carroll

[11] Patent Number: 5,214,740

[45] Date of Patent: May 25, 1993

[54] PORTABLE ELECTRIC HEATING APPARATUS FOR SUPPLYING HEATED DRY NON-FLAMMABLE GAS TO AN APPLICATOR GUN

[76] Inventor: Carl W. Carroll, 258 Marina Hills Circle, N.W., Charleston, Tenn. 37310

[21] Appl. No.: 829,769

[22] Filed: Jan. 31, 1992

[51] Int. Cl.[5] ..... H05B 1/02; H05B 3/06; F24H 3/06; F28F 19/00

[52] U.S. Cl. ..... 392/481; 239/135; 392/379; 392/397; 392/483

[58] Field of Search ..... 392/379–385, 392/465–495, 396–398; 239/133, 135, 136; 219/517

[56] References Cited

U.S. PATENT DOCUMENTS

| | | | |
|---|---|---|---|
| 1,162,537 | 11/1915 | Yager . | |
| 1,542,472 | 6/1925 | O'Neill et al. | 392/476 |
| 1,844,268 | 2/1932 | Alex | 392/487 |
| 1,946,262 | 2/1934 | Adams | 392/476 |
| 1,949,658 | 3/1934 | Remseth et al. | 392/476 |
| 1,985,280 | 12/1934 | Carleton | 392/478 |
| 2,250,623 | 7/1941 | Breen | 392/489 |
| 2,430,090 | 11/1947 | Urquhart | 392/481 X |
| 2,677,750 | 5/1954 | Taylor . | |
| 2,980,339 | 4/1961 | Bok et al. | 239/135 |
| 3,336,463 | 8/1967 | Johnson | 392/481 |
| 3,737,626 | 6/1973 | Davis et al. | 392/481 X |
| 3,770,201 | 11/1973 | Sanders . | |
| 3,835,294 | 9/1974 | Krohn et al. | 392/484 |
| 3,846,616 | 11/1974 | Beck . | |
| 4,147,923 | 4/1979 | Davis et al. . | |
| 4,199,675 | 4/1980 | Sharpless . | |
| 4,465,922 | 8/1984 | Kolibas . | |
| 4,480,172 | 10/1984 | Ciciliot et al. . | |
| 4,501,952 | 2/1985 | Lehrke . | |
| 4,527,712 | 7/1985 | Cobbs, Jr. et al. . | |
| 4,667,084 | 5/1987 | Regge . | |

*Primary Examiner*—Anthony Bartis
*Attorney, Agent, or Firm*—Allegretti & Witcoff

[57] ABSTRACT

An apparatus for electrically heating non-flammable gases, supplied to an applicator gun comprises an elongated housing having an elongated electric heater located centrally and longitudinally therein and a metallic helically coiled tube spaced from and surrounding the heater. The coiled tube is substantially co-extensive in length with the heater and has an inlet end and an outlet end connectable to an applicator gun. An elongated preheating tubing section is disposed length-wise of and surrounded by the helically coiled tube in spaced heat exchange relation with the electric heater. The preheating tubing section has an inlet end connectable to a supply of non-flammable gas and an outlet end connected to the inlet end of the coiled tube. A temperature responsive sensing means is positioned at the inlet end of the coiled tube in direct contact with the non-flammable gas flowing into the coiled tube from the preheating tubing section and an electrical control means operatively connected to the temperature responsive means controls the degree of energization of the heater in direct response to the actual temperature of the non-flammable gas at the inlet end of the coiled tube to vaporize any liquid present in the non-flammable gas flowing through the coiled tube before transfer to the an applicator gun.

6 Claims, 2 Drawing Sheets

PORTABLE ELECTRIC HEATING APPARATUS FOR SUPPLYING HEATED DRY NON-FLAMMABLE GAS TO AN APPLICATOR GUN

BACKGROUND OF THE INVENTION

This invention relates to a method and apparatus for heating non-flammable gases. More particularly, the method and apparatus of this invention pertains to heating air so that any liquid water that may be present therein is vaporized before the air is used in various applications, e.g. spray painting. The present invention can be used for many different applications.

The present invention is a significant improvement over the prior art. For example, U.S. Pat. No. 3,737,626 teaches a heating device having a housing with partitions, an electric heating unit located within one partition, a metallic coiled tubing surrounding the heating unit, supply means for admitting compressed air to one end of the coiled tubing, a filter casing with filter elements positioned within another partition, the filter casing being connected to the other end of the coiled tubing, exhaust means for carrying the dry, cleaned, and heated compressed air to the point of use, and electrical control means for the energization of the heating unit.

Of particular significance, U.S. Pat. No. 3,737,626 discloses that the heating unit has a temperature responsive sensing means positioned into the space between partitions of a housing. Thus, the temperature responsive sensing means measures the temperature of the air surrounding the coiled tubing and does not directly measure the actual temperature of the air within the coiled tubing which is being heated. The filter casing with filter elements is located at the outlet end of the coiled tubing to remove, among other things, any liquid water which was not vaporized by the heating unit. Although this technique has some advantages, it still requires a filtering system to remove liquid water which was not vaporized by the heating unit before the heated air is ready for its intended use.

U.S. Pat. No. 4,147,923 teaches a heating device having a housing having first and second compartments, an electric heating unit located centrally, first and second chambers, wherein the second compartment serves as a storage means for condensation formed in the first chamber, inlet means for admitting compressed air into the first chamber, outlet means for removing the compressed air from the second chamber, and electrical control means for controlling the degree of energization of the heating unit in response to the temperature of the heated air inside the second chamber. Although this technique has the advantage of directly measuring the temperature of the heated air, it requires a system for collecting and storing condensation. Furthermore, this technique also teaches the use of a filter means to remove liquid water which was not vaporized by the heating unit before the heated air is ready for its intended use.

The present invention retains the benefits of the prior art devices described above while eliminating the need for filtering or condensation systems to remove liquid water from the heated non-flammable gas, such as air, before the heated non-flammable gas is ready for its intended use.

U.S. Pat. No. 1,946,262 teaches a hand-operated hot air gun having a thermostat enclosed within a separate compartment in the gun barrel to prevent overheating of the device without increasing the time necessarily required to heat an electric heating element also within the hand-operated gun. Although this apparatus has some advantages, it requires treatment of the air within the hand-operated gun just prior to being dispensed through an outlet nozzle. Since the heating element is enclosed within the hand-operated gun, this apparatus increases safety hazards and renders the hand-operated gun more difficult to maneuver because it will be heavier and more cumbersome than it would be without the enclosed heating element and thermostat. The present invention completely eliminates the need for a heating element and thermostat within a hand-operated gun.

Thus, the present invention involves the discovery of the source not before known of a long-standing problem and the application of the remedy for that problem. Specifically, the present invention involves the discovery of the source of the long-standing problem of heating a non-flammable gas without the need for filtering systems, condensation systems, or problems associated with a heating element and thermostat enclosed within a hand-operated applicator gun. The source of the long-standing problem was inaccurate temperature measurement of the gas being heated and the inefficient temperature control of that gas before the gas was transferred to a hand-operated applicator gun.

The present invention applies a remedy for that problem by providing an elongated preheating tubing section having an outlet end connected to the inlet end of the coiled tube to provide non-flammable gas to the inlet end of the coiled tube and electrical control means operatively connected to a temperature responsive sensing means positioned at the inlet end of the helical tubing and in direct contact with the gas for sensing the actual temperature of the gas so that electric heating means will vaporize any liquid water present in the gas before the gas is tranferred to a hand-operated applicator gun.

SUMMARY OF THE INVENTION

This new invention teaches a portable heating having improved mechanical simplicity and surety over the prior art cited above. Specifically, the invention uses an elongated preheating tubing section and a helically coiled tube through which the non-flammable gas flows through as it is being heated; and electrical control means operatively connected to a temperature responsive sensing means positioned within and at the inlet end of the coiled tube and in direct contact with the non-flammable gas for sensing the actual temperature of the non-flammable gas. The present invention eliminates the need for filtering or condensation systems to remove condensation from the heated non-flammable gas as required by the prior art. In addition, the present invention eliminates the need for treating the gas within a hand-operated applicator gun as required by other prior art.

More particularly, the newly discovered heating method and apparatus comprises an elongated housing having wall and an electric heating means located centrally and longitudinally within the housing and mounted to at least one wall for vaporizing liquid water in the non-flammable gas. The apparatus and housing can be any suitable shape. The present invention also has a metallic helically coiled tube spaced from and surrounding the heating means, the coiled tube being substantially co-extensive in length with the heating means, the coiled tube having an inlet end and an outlet end and defining a non-obstructed helical pathway for the non-flammable gas to flow through. Further, the present invention includes an elongated preheating tubing section disposed length-wise and surrounded by the coiled tube in spaced heat exchange relation with the electric heating means, the preheating tubing section being connected to the inlet end of the coiled tube to provide non-flammable gas to the inlet end of the coiled tube. The present invention also includes means for connecting a supply means of a non-flammable gas to the inlet end of the preheating tubing section.

The significant improvements of the present invention over the prior art comprise the preheating tubing section and electrical control means mounted on the outer housing for controlling the degree of energization of the heating means in direct response to the actual temperature of the non-flammable gas at the inlet end of the coiled tube, the control means operatively connected to a temperature responsive sensing means positioned at the inlet end of the coiled tube to vaporize any liquid water present in the non-flammable gas flowing through the coiled tube and before the gas is transferred by piping means to an applicator gun. As noted above, it is preferable to position the temperature responsive sensing means substantially near the inlet end of the coiled tube. These improvements allow the heater to provide dry and heated non-flammable gas and eliminate the need for filtering or condensation systems to remove liquid water from the non-flammable gas before intended use and eliminates the need to treat the gas within the hand-operated applicator gun.

This new invention not only provides heated non-flammable gas for many applications, but also provides unsurpassed advantages over the prior art. First, the new invention takes advantage of a preheating tubing section and directly measuring the actual temperature of the non-flammable gas within the coiled tube itself. In its preferred embodiment, the temperature responsive sensing means is positioned at the inlet end of the coiled tube. In doing so, the present invention unexpectedly eliminates the need for filtering or condensation systems as required by prior art devices. Since no such systems are required, the present invention eliminates unnecessary down time for the cleaning or replacing of filter elements or the removal of condensate. The present invention also uses less space since it does not require filtering or condensation systems.

Second, the present invention works more efficiently than prior art devices in vaporizing liquid water that may be present in the non-flammable gas. Therefore, the present invention requires less electrical power than the prior art devices described above.

Further, the present invention eliminates the need to treat the gas within the hand-operated applicator gun as required in other prior art. Since no heating element or thermostat is required within the hand-operated applicator gun, the present invention improves operator safety and increases the ease of maneuverability and use of the hand-operated applicator gun.

DETAILED DESCRIPTION OF THE DRAWINGS

Figure 1:
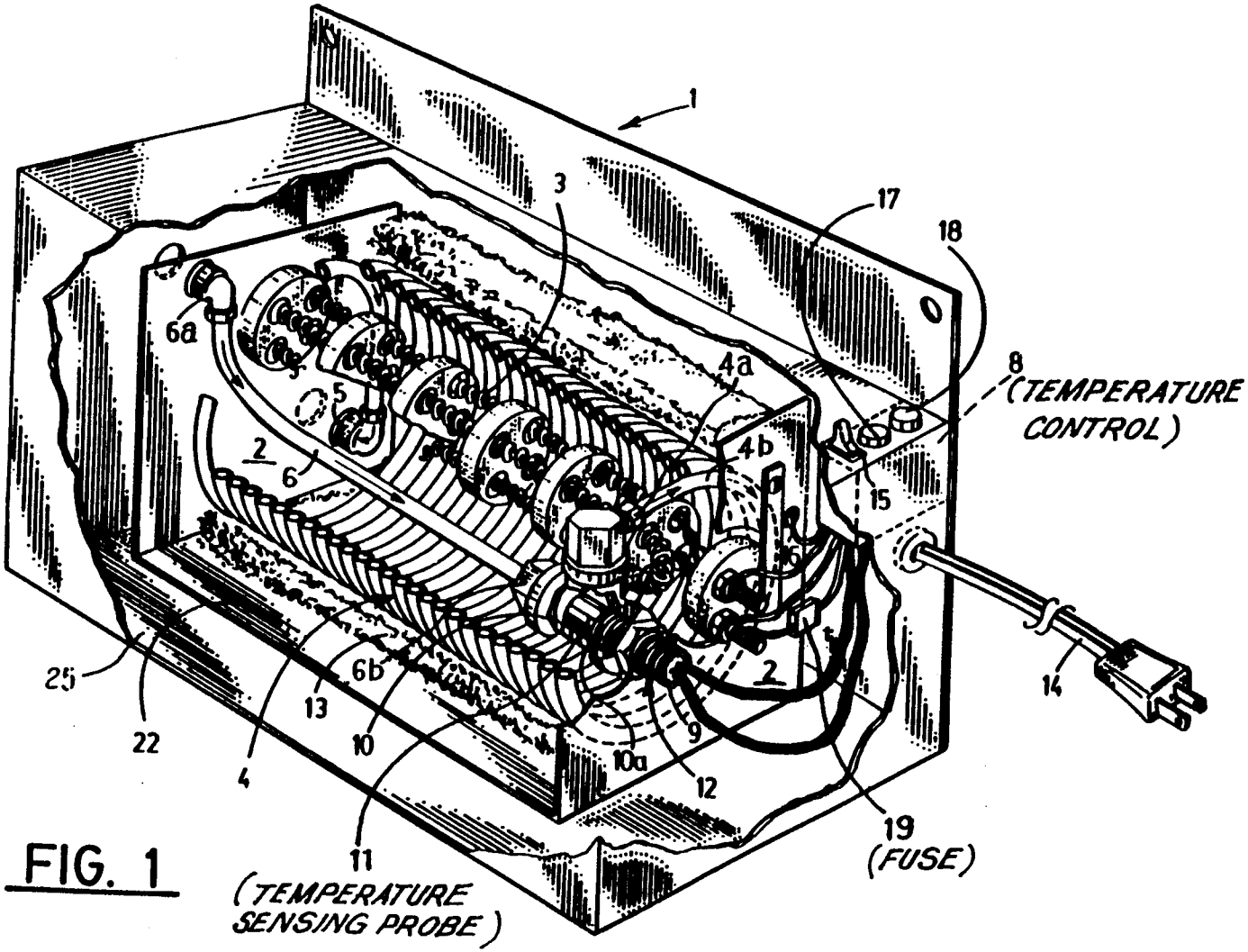
FIG. 1 is a perspective view of the invention.

As shown in FIG. 1, the present invention is a portable heater 1 for providing dry and heated non-flammable gas. Portable heater 1 has a rectangular outer housing 25 and a rectangular inner housing 22, the inner housing having end walls 2. Outer housing 25 surrounds inner housing 22 and end walls 2. Portable heater 1 also has an electric heating means 3 located centrally and longitudinally within the inner housing 22 and is mounted to at least one end wall of the inner housing for vaporizing liquid water in the non-flammable gas. In addition, portable heater 1 has a metallic coiled tube 4 spaced from and winding around and surrounding the heating means 3, the coiled tube 4 having an inlet end **4*a* and an outlet end 5 and defining a non-obstructed helical pathway 4*b*** for the non-flammable gas to flow through.

The significant improvements comprise electrical control means 8 mounted on the outer housing 25 for controlling the degree of energization of the heating means 3 in direct response to the actual temperature of the non-flammable gas at the inlet end of the coiled tube 4. The control means 8 is operatively connected to a temperature responsive sensing means 9 positioned at the inlet **4*a* end of the coiled tube 4 for measuring the actual temperature of the non-flammable gas. Control means 8 may include an automatic thermostat 12 to control the temperature of the non-flammable gas at the inlet end of the coiled tube 4 at a desired level. Preferably, temperature responsive sensing means 9 is positioned at or substantially near the inlet end 4*a* of the coiled tube 4**.

In addition, the present invention includes an elongated preheating tubing section 6 disposed length-wise and surrounded by the helically coiled tube 4 in spaced heat exchange relation with the electric heating means 3, the preheating tubing section 6 having an inlet end **6*a* and an outlet end 6*b*, the outlet end of the preheating tubing section 6 being connected to the inlet end of 4*a* of the coiled tube 4 to provide non-flammable gas to the inlet end 4*a* of the coiled tube 4**.

As shown in FIG. 1, the temperature responsive sensing means 9 is positioned at the inlet end **4*a* the coiled tube 4 via a side port 10*a* of a pipe T-section 10. It is understood that any suitable piping arrangement is contemplated for the present invention, and is not limited to the preferred embodiment shown in FIG. 1. temperature responsive sensing means 9 includes temperature probe sensor 11**.

Temperature probe sensor 11 is located at the pipe T-section 10 and directly measures the actual temperature of the non-flammable gas. The non-flammable gas may be air.

Figure 2:
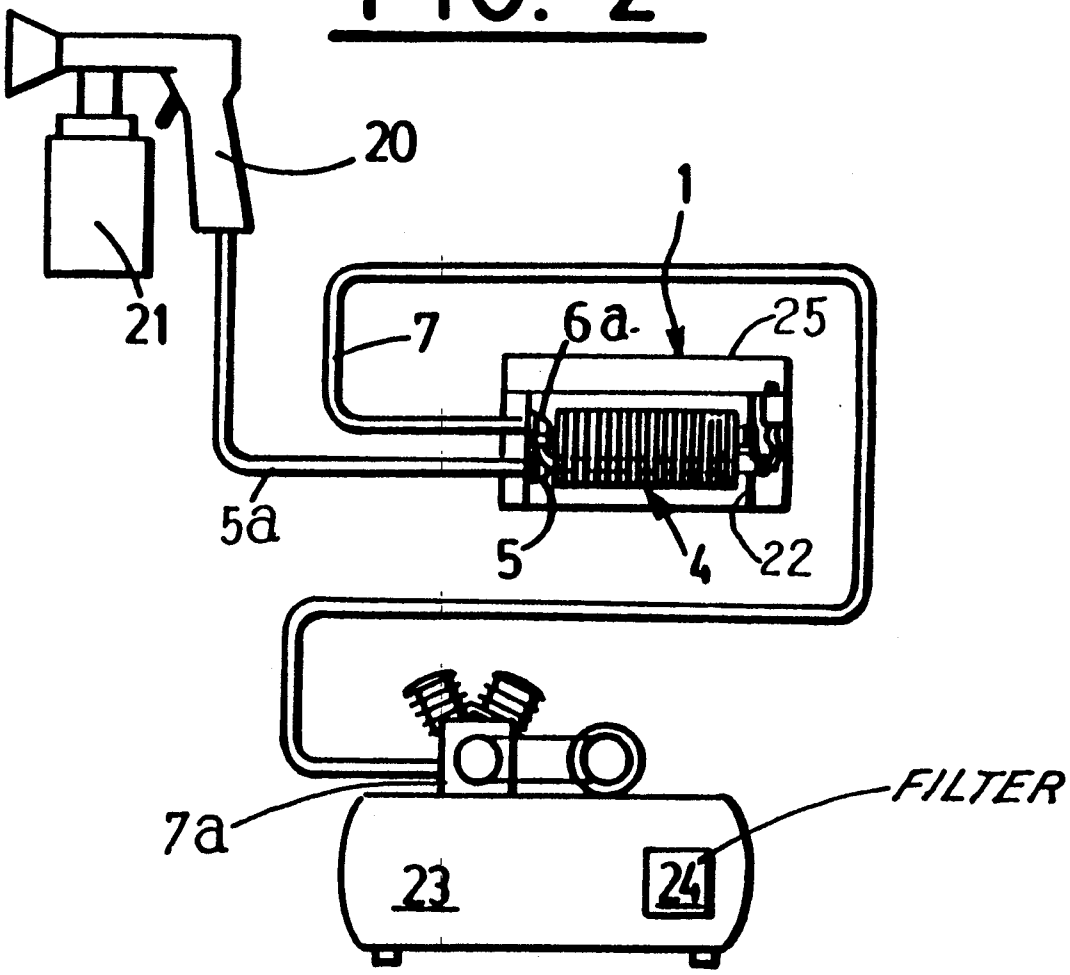
FIG. 2 is a schematic drawing of the invention when used in a spray painting application.

As shown in FIG. 2, means 7 for connecting a supply means **7*a* of a non-flammable gas may also be provided. Means 7 can be any suitable piping arrangement. Supply means 7*a* may pressurize the non-flammable gas, e.g. via compressor means 23. Supply means 7 and/or means 7 may also include filter means 24** to remove particulates and liquid water from the non-flammable gas before it is heated.

Ceramic wool blanket 13 extends around coiled tube 4 to provide insulation and increase operator safety.

Electric current is supplied to the control means 8 via power supply cord 14. Control means 8 has power switch 15, which turns the device 1 "ON" or "OFF".

Grounding wire 16 of the power supply cord 14 grounds control means 8 when mounted to end wall 2 to increase operator safety. Control means 8 may have a green indicator light 17 to indicate when switch 15 is in the "on" or "off" position. Control means 8 may also have a red indicator light 18 to indicate when heating means 3 is using electric current to heat the non-flammable gas.

Control means 8 may also have an excess-current responsive means 19 to shut off electric power to heating means 3 when the electric power goes above a suitable level. Excess-current responsive means 19 is located between heating means 3 and power switch 15.

As shown in FIG. 2, the invention can be used in a spray painting application. Compressor means 23 has filter means 24 to remove particulates and liquid water from the non-flammable gas (i.e. air in this application) before heating.

Through means 7 supply means 7*a* provides the air to inlet end 6*a* of the preheating tubing section 6, which in turn provides the air to the coiled tube 4. Also shown in FIG. 2 is piping means 5*a* for transferring treated gas from the coiled tube 4 a hand-operated applicator gun 20. After heating the piping means 5*a* provides the now dry and heated air to hand-operated applicator gun 20 where it is mixed with paint 21 for application.

It is expected that the present invention can be used in many other applications besides general spray painting applications. For example, the invention can be used effectively in applying finishes to photographs in the photofinishing process, in the melting of nylon chips (using nitrogen) for the manufacturing of nylon fabric to increase tensile strength of the fabric; in conjunction with welding machines and metal cutting machines (using argon) to prevent tips and torches from arcing and prematurely burning out. The invention has proved to be effective in extending the useful life of solenoid valves, switches, and various air tools. In robotics, heated and conditioned compressed air extends time between preventive maintenance shut downs and prevents lubricants from waxing. In dentistry, conditioned air prevents internal corrosion of drills and other air tools and warm air applied to sensitive mouth areas is more soothing to patients than cold air. The invention may also be used in conjunction with non-compressed sprayers using ambient air.

Numerous other uses of the invention will obviously come to mind. The above cited applications do not limit the use of the invention, and are set forth merely for the purposes of illustration.

The foregoing detailed description of the invention has been made in general terms and with respect to several preferred embodiments. Many of the preferred materials and methods stated herein may be varied by persons skilled in the art without departing from the spirit and scope of this invention. Accordingly, the invention resides solely in the claims hereinafter appended.

What is claimed is:

1. A portable heater for providing dry non-flammable gas to an applicator gun having:

an elongated housing having walls, an elongated electric heating means located centrally and longitudinally within the housing for heating the non-flammable gas, a metallic helically coiled tube in said housing spaced from and surrounding the heating means, the coiled tube being substantially co-extensive in length with the heating means, said coiled tube having an inlet end and an outlet end and defining a non-obstructed pathway for the non-flammable gas to flow through, an elongated preheating tubing section disposed length-wise of surrounded by said helically coiled tube in spaced heat exchange relation with the electric heating means, the preheating tubing section having an inlet end and an outlet end, the outlet end of the preheating tubing section being connected to the inlet end of the coiled tube to provide non-flammable gas to the inlet end of the coiled tube, means for connecting a supply means of a non-flammable gas to the inlet end of the preheating tubing section, temperature responsive sensing means positioned at the inlet end of the coiled tube and in direct contact with the non-flammable gas for sensing the actual temperature of the non-flammable gas flowing into the coiled tube from the preheating tubing section, and electrical control means operatively connected to the temperature responsive sensing means arranged to control the degree of energization of the heating means in direct response to the actual temperature of the non-flammable gas at the inlet end of the helically coiled tube and to vaporize any liquid present in the non-flammable gas flowing through the helically coiled tube and before the gas is transferred to the applicator gun.

2. The heater of claim 1 wherein the temperature responsive sensing means is positioned via a side port of a pipe T-section connected to the inlet end of the helically coiled tube.

3. The heater of claim 1 wherein the supply means pressurizes the non-flammable gas.

4. The heater of claim 1 wherein the control means includes an automatic thermostat responsive to said temperature sensing means to control the temperature of the non-flammable gas within the helically coiled tube at a desired level.

5. The heater of claim 1 wherein the control means includes an excess-current responsive means for cutting off electrical power to the heating means when the electrical power goes above a suitable level.

6. The heater of claim 1 including means for connecting the treated gas from the outlet of the helically coiled tube to an applicator gun.

* * * * *